US008500604B2

(12) United States Patent
Srinivasan et al.

(10) Patent No.: US 8,500,604 B2
(45) Date of Patent: Aug. 6, 2013

(54) WEARABLE SYSTEM FOR MONITORING STRENGTH TRAINING

(75) Inventors: Soundararajan Srinivasan, Munhall, PA (US); Juergen Heit, Pittsburgh, PA (US); Aca Gacic, Pittsburgh, PA (US); Rahul Kapoor, Pittsburgh, PA (US); Burton W Andrews, Pittsburgh, PA (US)

(73) Assignee: Robert Bosch GmbH, Stuttgart (DE)

( * ) Notice: Subject to any disclaimer, the term of this patent is extended or adjusted under 35 U.S.C. 154(b) by 950 days.

(21) Appl. No.: 12/581,124

(22) Filed: Oct. 17, 2009

(65) Prior Publication Data

US 2011/0092337 A1 Apr. 21, 2011

(51) Int. Cl.

| | |
|---|---|
| ***A63B 71/00*** | (2006.01) |
| ***A61B 5/103*** | (2006.01) |
| ***A61B 5/00*** | (2006.01) |
| ***A61B 5/11*** | (2006.01) |

(52) U.S. Cl.
USPC ..... 482/8; 482/1; 482/3; 600/595; 600/587; 434/247; 73/865.4; 73/379.01

(58) Field of Classification Search
USPC .. 482/1–9; 600/587, 595; 434/247; 73/865.4, 73/379.01
See application file for complete search history.

(56) References Cited

U.S. PATENT DOCUMENTS

| | | | | |
|---|---|---|---|---|
| 5,476,103 | A | 12/1995 | Nahsner | |
| 5,785,632 | A | 7/1998 | Greenberg et al. | |
| 5,980,429 | A | 11/1999 | Nashner | |
| 6,626,800 | B1 | 9/2003 | Casler | |
| 6,632,158 | B1 | 10/2003 | Nashner | |
| 7,072,789 | B2 * | 7/2006 | Vock et al. | 702/141 |
| 7,421,369 | B2 * | 9/2008 | Clarkson | 702/150 |
| 7,658,694 | B2 * | 2/2010 | Ungari | 482/1 |
| 7,658,695 | B1 * | 2/2010 | Amsbury et al. | 482/8 |
| 7,670,263 | B2 * | 3/2010 | Ellis et al. | 482/8 |
| 7,717,827 | B2 * | 5/2010 | Kurunmaki et al. | 482/8 |
| 7,728,723 | B2 * | 6/2010 | Niva et al. | 340/539.11 |
| 7,753,861 | B1 * | 7/2010 | Kahn et al. | 600/595 |
| 7,841,966 | B2 * | 11/2010 | Aaron et al. | 482/8 |
| 7,846,068 | B2 * | 12/2010 | Oshima et al. | 482/8 |

(Continued)

FOREIGN PATENT DOCUMENTS

WO 0164098 A1 9/2001

OTHER PUBLICATIONS

Porterfield et al., "Teen time use and parental education: evidence from the CPS, MTF, and ATUS", (2007), Monthly Labor Review, pp. 37-56 (20 pages).

(Continued)

*Primary Examiner* — Loan Thanh
*Assistant Examiner* — Sundhara Ganesan
(74) *Attorney, Agent, or Firm* — Maginot, Moore & Beck

(57) ABSTRACT

An exercise monitoring method and system in one embodiment includes a communications network, a wearable transducer configured to generate physiologic data associated with movement of a wearer, and to form a communication link with the communications network, a system memory in which command instructions are stored, a user interface operably connected to the computer, and a system processor configured to execute the command instructions to receive the generated physiologic data, analyze the received physiologic data with a multilayer perceptron/support vector machine/hidden Markov (MSH) model, model the analyzed physiologic data, and generate feedback based on a comparison of the model and a stored exercise object.

20 Claims, 10 Drawing Sheets

U.S. PATENT DOCUMENTS

| | | | | |
|---|---|---|---|---|
| 7,953,549 | B2 * | 5/2011 | Graham et al. | 701/466 |
| 7,972,245 | B2 * | 7/2011 | Temple et al. | 482/8 |
| 7,980,997 | B2 * | 7/2011 | Thukral et al. | 482/8 |
| 7,980,999 | B2 * | 7/2011 | Kawaguchi et al. | 482/8 |
| 8,021,312 | B2 * | 9/2011 | Kinnunen et al. | 600/595 |
| 8,033,959 | B2 * | 10/2011 | Oleson et al. | 482/9 |
| 8,088,042 | B2 * | 1/2012 | Limma et al. | 482/8 |
| 8,092,355 | B2 * | 1/2012 | Mortimer et al. | 482/142 |
| 8,109,858 | B2 * | 2/2012 | Redmann | 482/8 |
| 8,162,804 | B2 * | 4/2012 | Tagliabue | 482/8 |
| 8,165,901 | B2 * | 4/2012 | Raymond | 705/3 |
| 8,187,182 | B2 * | 5/2012 | Kahn et al. | 600/300 |
| 2004/0043869 | A1 * | 3/2004 | Sato et al. | 482/8 |
| 2005/0233860 | A1 * | 10/2005 | Inoue | 482/8 |
| 2006/0020177 | A1 * | 1/2006 | Seo et al. | 600/300 |
| 2006/0025282 | A1 * | 2/2006 | Redmann | 482/8 |
| 2006/0064037 | A1 * | 3/2006 | Shalon et al. | 600/586 |
| 2007/0072158 | A1 * | 3/2007 | Unuma et al. | 434/247 |
| 2007/0173377 | A1 * | 7/2007 | Jamsen et al. | 482/8 |
| 2007/0219059 | A1 * | 9/2007 | Schwartz et al. | 482/8 |
| 2007/0287596 | A1 * | 12/2007 | Case et al. | 482/8 |
| 2008/0096726 | A1 * | 4/2008 | Riley et al. | 482/8 |
| 2008/0096727 | A1 * | 4/2008 | Lee et al. | 482/8 |
| 2008/0146416 | A1 * | 6/2008 | Mueller et al. | 482/8 |
| 2008/0171636 | A1 * | 7/2008 | Usui et al. | 482/8 |
| 2008/0200310 | A1 * | 8/2008 | Tagliabue | 482/8 |
| 2008/0258921 | A1 * | 10/2008 | Woo et al. | 340/573.1 |
| 2008/0300914 | A1 * | 12/2008 | Karkanias et al. | 705/2 |
| 2009/0005220 | A1 * | 1/2009 | Lee et al. | 482/8 |
| 2009/0016610 | A1 * | 1/2009 | Ma et al. | 382/195 |
| 2009/0048070 | A1 * | 2/2009 | Vincent et al. | 482/8 |
| 2009/0143199 | A1 * | 6/2009 | Nishibayashi | 482/8 |
| 2009/0325766 | A1 * | 12/2009 | Kasama et al. | 482/8 |
| 2009/0326341 | A1 * | 12/2009 | Furlan | 600/301 |
| 2010/0035727 | A1 * | 2/2010 | Brunner | 482/8 |
| 2010/0045463 | A1 * | 2/2010 | Bradley et al. | 340/573.1 |
| 2010/0069203 | A1 * | 3/2010 | Kawaguchi et al. | 482/8 |
| 2010/0075806 | A1 * | 3/2010 | Montgomery | 482/8 |
| 2010/0075807 | A1 * | 3/2010 | Hwang et al. | 482/8 |
| 2010/0099539 | A1 * | 4/2010 | Haataja | 482/8 |
| 2010/0105525 | A1 * | 4/2010 | Thukral et al. | 482/8 |
| 2010/0120584 | A1 * | 5/2010 | Oshima et al. | 482/8 |
| 2010/0144414 | A1 * | 6/2010 | Edis et al. | 463/8 |
| 2011/0021317 | A1 * | 1/2011 | Lanfermann | 482/8 |

OTHER PUBLICATIONS

Faigenbaum, Avery D., Strength Training for Children and Adolescents, Clinics in Sports Medicine, Oct. 2000, pp. 593-619, vol. 19 No. 4, Elsevier (27 pages).

Feigenbaum et al., Prescription of Resistance Training for Health and Disease, Medicine & Science in Sports & Exercise, Jan. 1999, pp. 38-45, vol. 31 Issue 1, American College of Sports Medicine, Wolters Kluwer, Lippincott Williams & Wilkins (14 pages).

Thompson, Walter R., Worldwide Survey Reveals Fitness Trends for 2008, ACSM's Health and Fitness Journal, 2007, pp. 7-13, vol. 11 No. 6, American College of Sports Medicine, Wolters Kluwer, Lippincott Williams & Wilkins (7 pages).

TrainMe, Available at http://people.csail.mit.edu/hal/mobile-apps-fall-08/pdfs/trainme.pdf, accessed on Jan. 26, 2009.

Zatsiorsky et al., Science and Practice of Strength Training Second Edition, May 2006, pp. 3-15, Human Kinetics (22 pages).

* cited by examiner

WEARABLE SYSTEM FOR MONITORING STRENGTH TRAINING

FIELD

This invention relates to wearable monitoring devices.

BACKGROUND

Physical fitness has been a growing concern for both the government as well as the health care industry due to the decline in the time spent on physical activities by both young teens as well as older adults. Self monitoring of individuals has proven to be helpful in increasing awareness of individuals to their activity habits. By way of example, self-monitoring of sugar levels by a diabetic helps the diabetic to modify eating habits leading to a healthier lifestyle.

Self-monitoring and precisely quantizing physical movements has also proven to be important in disease management of patients with chronic diseases, many of which have become highly prevalent in the western world. Athletes also monitor their exercise routines to optimize performance. A plethora of different devices and applications have surfaced to serve the needs of the community ranging from simple pedometers to complex web-based tracking programs.

Wearable devices and sensors have seen a tremendous global growth in a range of applications including monitoring physical movements. While known systems are able, to some extent, to ascertain results of certain movements that an individual is undertaking, these systems are not able to provide detailed information as to whether the movements are being undertaken in a correct manner.

Micro-electromechanical system (MEMS) sensors, which have a small form factor and exhibit low power consumption without compromising on performance, have received increased attention for incorporation into wearable sensors. For example, inertial MEMS sensors such as accelerometers can be placed into an easy and light portable device to be worn by and monitored by users. In this context a user can be a wearer of such a device, a coach who desires to monitor the progress of a player who is wearing such a device, a therapist who is monitoring the healing progression of an injured athlete, etc.

Until recently, it has been challenging for an individual to track, record, and report physical activities. Assessment and feedback concerning physical progress and the correctness of a performed physical activity could only be accurately provided by an observer, e.g., by a coach or by a physical therapist.

Accordingly, there is a need for a smarter system including applications and wearable devices that track, record and report physical exercise of the wearer. A further need exist for a system that is context aware and which allows assessment of correctness of the performed physical exercises and which is capable of providing feedback to a user as to whether the user is correctly engaging in a particular series of movements. It would be beneficial if such a device did not require user intervention during the course of these movements. Therefore, a system which monitored a subject's movements and provided real-time detailed information as to whether the movements are being performed correctly, and also provided feedback related to the movements would be beneficial.

SUMMARY

An exercise monitoring method and system in one embodiment includes a communications network, a wearable transducer configured to generate physiologic data associated with movement of a wearer, and to form a communication link with the communications network, a system memory in which command instructions are stored, a user interface operably connected to the computer, and a system processor configured to execute the command instructions to receive the generated physiologic data, analyze the received physiologic data with a multilayer perceptron/support vector machine/hidden Markov (MSH) model, model the analyzed physiologic data, and generate feedback based on a comparison of the model and a stored exercise object.

In accordance with another embodiment, a method of monitoring physiologic data associated with an exercise routine performed by a user, includes generating physiologic data, receiving the generated physiologic data, analyzing the received physiologic data with a multilayer perceptron/support vector machine/hidden Markov (MSH) model, modeling the analyzed physiologic data, and generating feedback based on a comparison of the model and a stored exercised object.

In yet another embodiment, a method of monitoring physiologic data associated with an exercise routine performed by a user, includes selecting an exercise routine, receiving an exercise object for a model exercise routine associated with the selected exercise routine, transmitting physiologic data associated with sensed physiologic conditions of a user, analyzing the transmitted physiologic data, generating a model based on the analyzed transmitted physiologic data, comparing the exercise object with the model, and generating selective feedback based on the comparison.

DESCRIPTION

Figure 1:
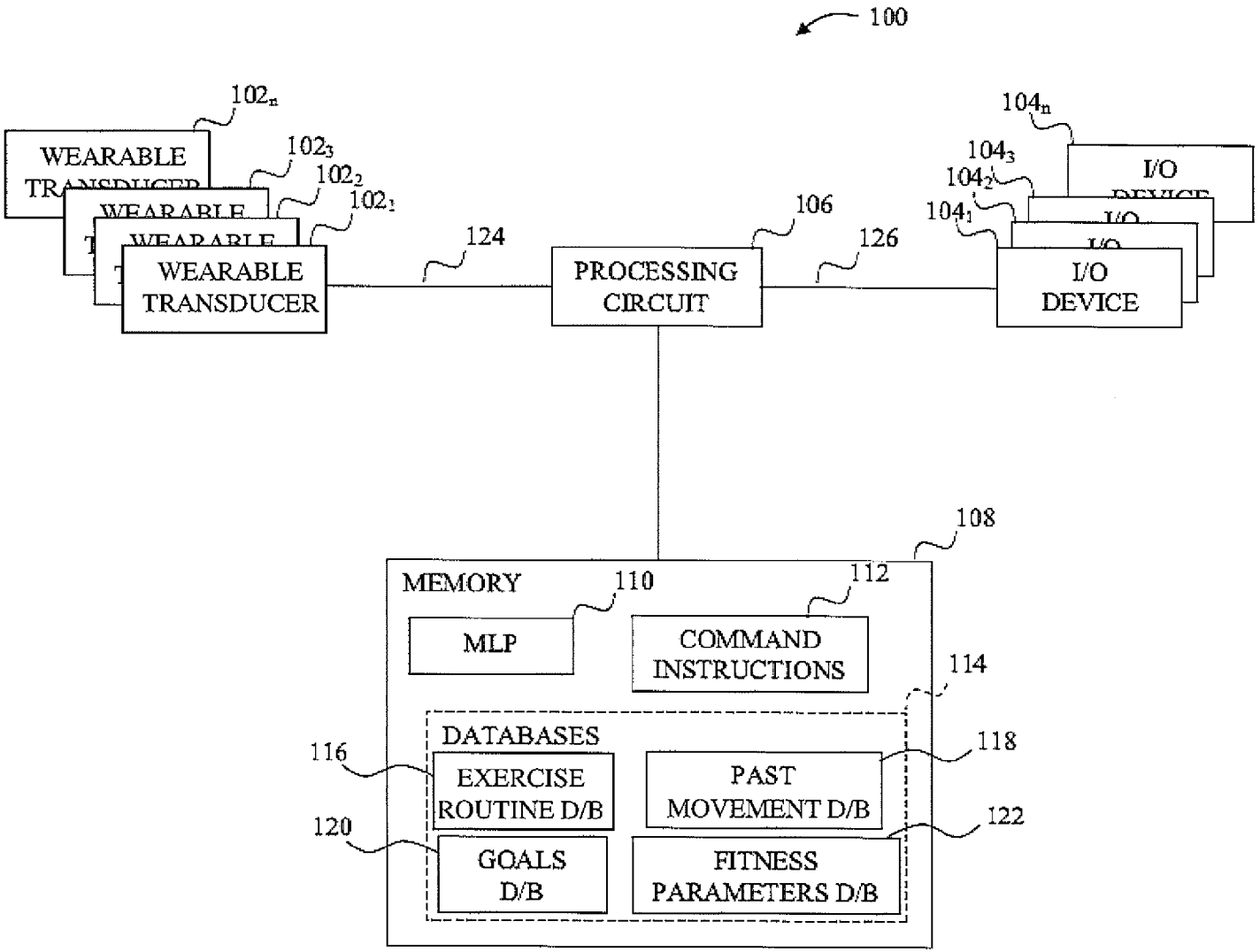
FIG. 1 depicts a block diagram of an exercise monitoring network including wearable transducer devices in accordance with principles of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Referring to FIG. 1, there is depicted a representation of a physical movement monitoring network generally designated 100. The network 100 includes a plurality of wearable transducers $\mathbf{102}_x$, input/output (I/O) devices $\mathbf{104}_x$, a processing circuit 106 and a memory 108. The I/O devices $\mathbf{104}_x$ may include a user interface, graphical user interface, keyboards, pointing devices, remote and/or local communication links, displays, and other devices that allow externally generated information to be provided to the processing circuit 106, and that allow internal information of the processing circuit 106 to be communicated externally.

The processing circuit 106 may suitably be a general purpose computer processing circuit such as a microprocessor and its associated circuitry. The processing circuit 106 is operable to carry out the operations attributed to it herein.

Within the memory 108 is a multilayer perceptron/support vector machine/hidden Markov model 110, collectively hereinafter referred to as the MSH 110, and command instructions 112. The command instructions 112, which are described more fully below, are executable by the processing circuit 106 and/or any other components as appropriate.

The memory 108 also includes databases 114. While the databases 114 are depicted as a sub-block of the memory 108, persons skilled in art appreciate that one or more of the databases 114 can be a remote database that is not physically connected to the memory 108. The databases 114 include an exercise routine database 116, a past movement database 118, a goals database 120, and a fitness parameters database 122. In one embodiment, the databases are populated using object oriented modeling. The use of object oriented modeling allows for a rich description of the relationship between various objects.

A communications network 124 provides communications between the processing circuit 106 and the wearable transducers $\mathbf{102}_x$ while a communications network 126 provides communications between the processing circuit 106 and the I/O devices $\mathbf{104}_x$. While only one communication network 126 is depicted in FIG. 1, persons skilled in the art appreciate that several alternative communication networks may be used to establish communication between the processing circuit 106 and the I/O devices $\mathbf{104}_x$. These alternative networks may incorporate technologies such as WLAN, Bluetooth, USB, internet, etc. In alternative embodiments, some or all of the communications network 124 and the communications network 126 may include shared components.

In the embodiment described herein, the communications network 124 is a wireless communication scheme implemented as a wireless area network. A wireless communication scheme identifies the specific protocols and RF frequency plan employed in wireless communications between sets of wireless devices. To this end, the processing circuit 106 employs a packet-hopping wireless protocol to effect communication by and among the processing circuit 106 and the wearable transducers $\mathbf{102}_x$.

The wearable transducers $\mathbf{102}_x$ are similar in their underlying structures and are described in more detail with reference to the wearable transducer $\mathbf{102}_1$ shown in FIG. 2. Some modifications between wearable transducers $\mathbf{102}_x$ may be incorporated to optimize the input and feedback of the transducer.

Figure 2:
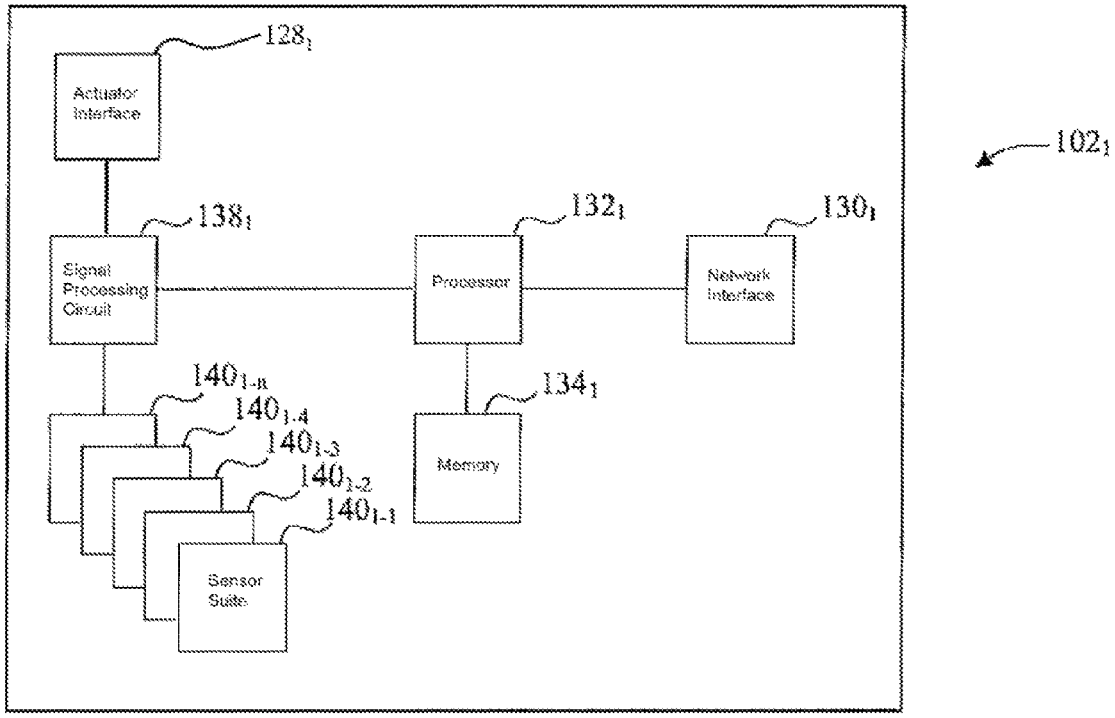
FIG. 2 depicts a schematic of a wearable transducer of FIG. 1 including at least one communication circuit and at least one sensor suite.

Referring to FIG. 2, the transducer $\mathbf{102}_1$ includes a network interface $\mathbf{130}_1$, a processor $\mathbf{132}_1$, a non-volatile memory $\mathbf{134}_1$, a signal processing circuit $\mathbf{138}_1$, sensor suites $\mathbf{140}_{1\text{-}x}$, and an actuator interface $\mathbf{128}_1$. The wearable transducer $\mathbf{102}_1$ depicted in FIG. 2 represents one of the wearable transducers $\mathbf{102}_x$ of FIG. 1. Therefore, the indexes are based on 1-x. A second wearable transducer $\mathbf{102}_2$ (not shown) would be represented by indexes 2-x.

The network interface $\mathbf{130}_1$ is a communication circuit that effectuates communication with one or more components of the communications network 124. To allow for wireless communication with the other components of the communications network 124, the network interface $\mathbf{130}_1$ is preferably a radio frequency (RF) modem configured to communicate using a wireless area network communication scheme. Thus, each of the transducers $\mathbf{102}_x$ may communicate with components such as other communication subsystems and the processing circuit 106.

The network interface $\mathbf{130}_1$ is further operable to, either alone or in conjunction with the processor $\mathbf{132}_1$, interpret messages in wireless communications received from external devices and determine whether the messages should be retransmitted to another external device as discussed below, or processed by the processor $\mathbf{132}_1$. Preferably, the network interface $\mathbf{130}_1$ employs a packet-hopping protocol to reduce the overall transmission power required. In packet-hopping, each message may be transmitted through multiple intermediate communication subsystem interfaces before it reaches its destination as is known in the relevant art.

As discussed above, the local RF communication circuit of the network interface $\mathbf{130}_1$ may suitably include an RF modem, or some other type of short range (about 30-100 feet) RF communication modem. In one embodiment, linking to a user group of devices or to the processor 106 may be achieved by using Bluetooth technology protocols communicating in an Industrial, Scientific, and Medical (ISM) frequency band, or other communication systems. The use of an RF communication circuit allows for reduced power consumption, thereby enabling the wearable transducer $\mathbf{102}_1$ to be battery operated, if desired. Operating the wearable transducer $\mathbf{102}_X$ with a battery enables device mobility and avoids the necessity of attaching wires to the transducer $\mathbf{102}_X$ for power supply. The sensor suites $\mathbf{140}_{1\text{-}x}$ can be used to enable power management approaches. In one embodiment, a power management utility can run on the processor $\mathbf{132}_X$. This program can turn off the RF circuitry in the network interface block $\mathbf{130}_X$ as well as other components of the transducer $\mathbf{102}_X$. A MEMS inertial sensor located in sensor suites $\mathbf{140}_{1\text{-}x}$ can automatically reactivate the power management program of the processor $132_X$ which can in turn reactivate other components of the transducer $102_X$. The life of the wearable transducer $102_1$ may be extended using power management approaches. Additionally, the battery may be augmented or even replaced by incorporating structure within the MEMS module to use or convert energy in the form of vibrations or ambient light. In some embodiments, a single circuit functions as both a network interface and a local RF communication circuit.

The local RF communication circuit of the network interface $130_1$ may be self-configuring and self-commissioning. Accordingly, when the wearable transducers $102_x$ are placed within communication range of each other, they will form a body-area network. In the case that a wearable transducer $102_x$ is placed within range of an existent body-area network, the wearable transducer $102_x$ will join the existent body-area network.

The processor $132_1$ is a processing circuit operable to control the general operation of the transducer $102_1$. In addition, the processor $132_1$ may implement control functions and information gathering functions used to maintain the databases 114.

The programmable non-volatile memory $134_1$, which may be embodied as a flash programmable EEPROM, stores configuration information for the sensor suites $140_{1-x}$. The programmable non-volatile memory $134_1$ includes an "address" or "ID" of the wearable transducer $102_1$ that is appended to any communications generated by the wearable transducer $102_1$. The memory $134_1$ further includes set-up configuration information related to the system communication parameters employed by the processor $132_1$ to transmit information to other devices.

Figure 3A:
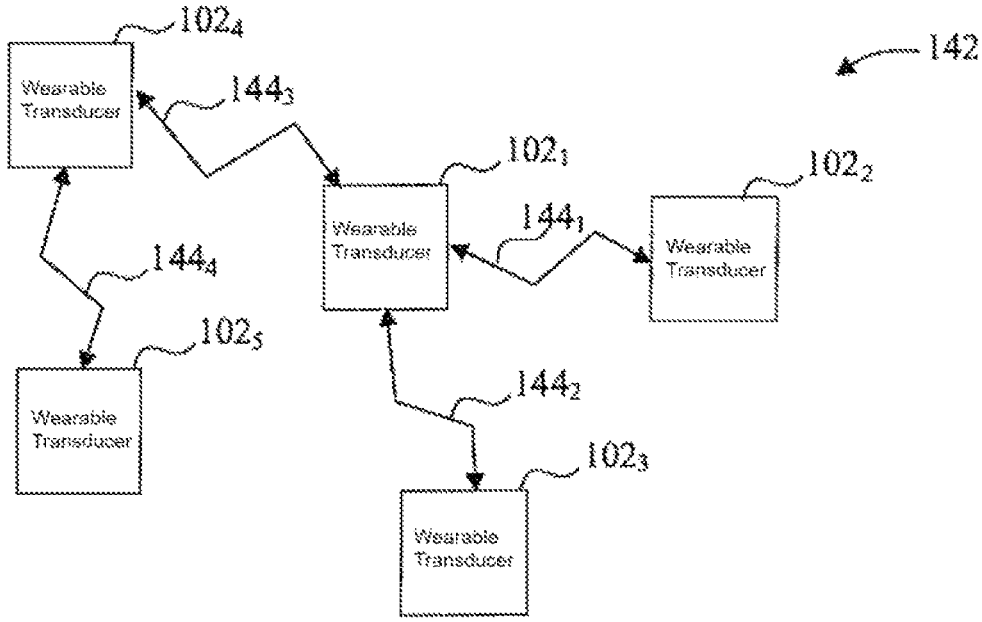
FIG. 3*a* depicts the wearable transducers of FIG. 1 connected into a body-area network with a hub transducer and a plurality of slave transmitters according to one embodiment.

Accordingly, the wearable transducers $102_x$ are formed into one or more communication subsystems such as the communication subsystem 142 shown in FIG. 3*a*. The communication subsystem 142 includes a hub wearable transducer $102_1$, and slave wearable transducer $102_2$, $102_3$, and $102_4$. Additionally, a slave transmitter $102_5$ is within the communication subsystem 142 as a slave to the slave transmitter $102_4$. The wearable transducer $102_1$ establishes a direct connection with the processing circuit 106 over the network 124. The slave wearable transducer $102_2$, $102_3$, $102_4$, and $102_5$ communicate with the processing circuit 106 through the wearable transducer $102_1$. It will be appreciated that a particular communication subsystem 142 may contain more or fewer wearable transducers $102_x$ than the wearable transducers $102_x$ shown in FIG. 3*a*.

Thus, the communication circuits of the network interfaces $130_x$ in the wearable transducers $102_1$, $102_2$, $102_3$, and $102_4$ are used to link with the communication circuits of the network interface 130, in the other wearable transducers $102_x$ to establish body-area network links $144_{1-3}$ (see FIG. 3*a*). The communication circuits of the network interfaces $130_x$ of the slave wearable transducers $102_4$ and $102_5$ also establish a body-area network link $144_4$.

Figure 3B:
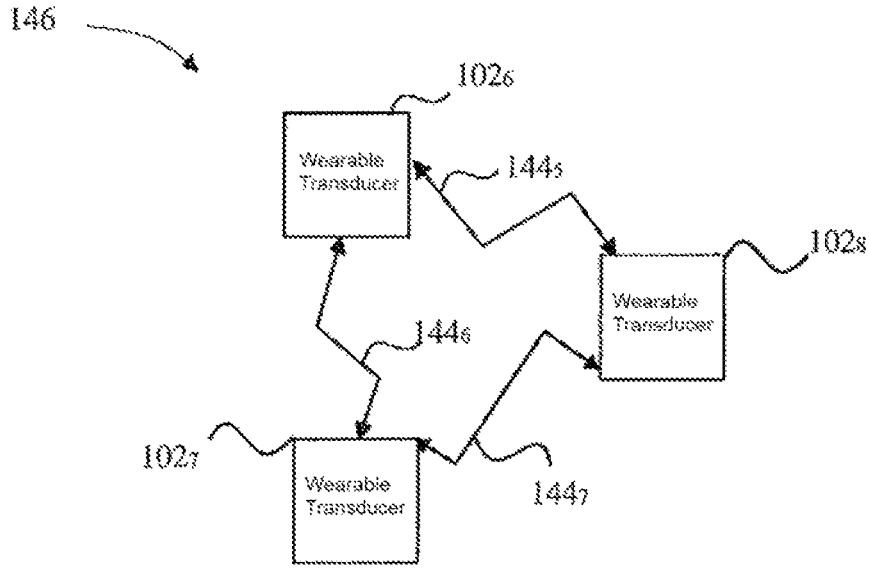
FIG. 3*b* depicts the wearable transducers of FIG. 1 connected into a body-area network with each of a plurality of transducers in communication with other transducers according to one embodiment.

In other embodiments a communication subsystem 146 as shown in FIG. 3*b*, is established in the communication subsystem 146, each of the wearable transducers $102_x$ ($102_6$-$102_8$) form a communication link $144_x$ with each of the other wearable transducers $102_x$, to form the links $144_5$, $144_6$, and $144_7$.

In yet another embodiment the transducers 102*x* are capable of communicating with the processing circuit 106 directly.

Returning to FIG. 2, the signal processing circuit $138_1$ includes circuitry that interfaces with the sensor suites $140_{1-x}$, converts analog sensor signals to digital signals, and provides the digital signals to the processor $132_1$. Furthermore, the signal processing circuit $138_1$ interfaces with the actuator interface $128_1$ to provide feedback to a wearer of the transducer 102, as will be discussed in greater detail below. The processor $132_1$ receives digital sensor information from the signal processing circuit $138_1$, and from other sensors $102_x$, provides digital signals to the signal processing circuit $138_1$ to generate feedback, and provides information to the communication circuit 124.

Feedback is generated from short term metrics in real-time, such as counts of correct repetitions/sets, velocity and acceleration of each repetition. Feedback may further be generated based on long term metrics such as improvements in strength, flexion, extension, rotation etc. Also, information about timing between repetitions of an exercise routine, such as durations of breaks taken between the repetitions, may be tracked and used to generated feedback.

The sensor suites $140_{1-x}$ include a sensor suite $140_{1-1}$ which in this embodiment is a 3-axis gyroscope sensor suite which provides information as to the orientation of the wearable transducer $102_1$. Other sensors which may be incorporated into the sensor suites $140_{1-x}$ include an electromyography sensor, galvanic skin response sensor, magnetometer, calorimeter, a pulse sensor, a blood oxygen content sensor, a global positioning system (GPS) sensor, and a temperature sensor. One or more of the sensor suites $140_{1-x}$ may include MEMS technology.

The actuator interface $128_1$ includes various feedback generating mechanisms. In one embodiment, a piezoelectric component or a vibration motor with an eccentric actuator can be configured to generate a tactile vibrational feedback to the wearer of the transducer $102_1$. In another embodiment, the actuator interface $128_1$ can be configured to produce an audio feedback. In yet another embodiment in which the transducer $102_1$ makes contact with the skin of the wearer of the transducer $102_1$, the actuator interface $128_1$ can be configured to produce a thermal feedback by either heating (via a resistive device) or cooling (via a thermo-resistive device).

Figure 4:
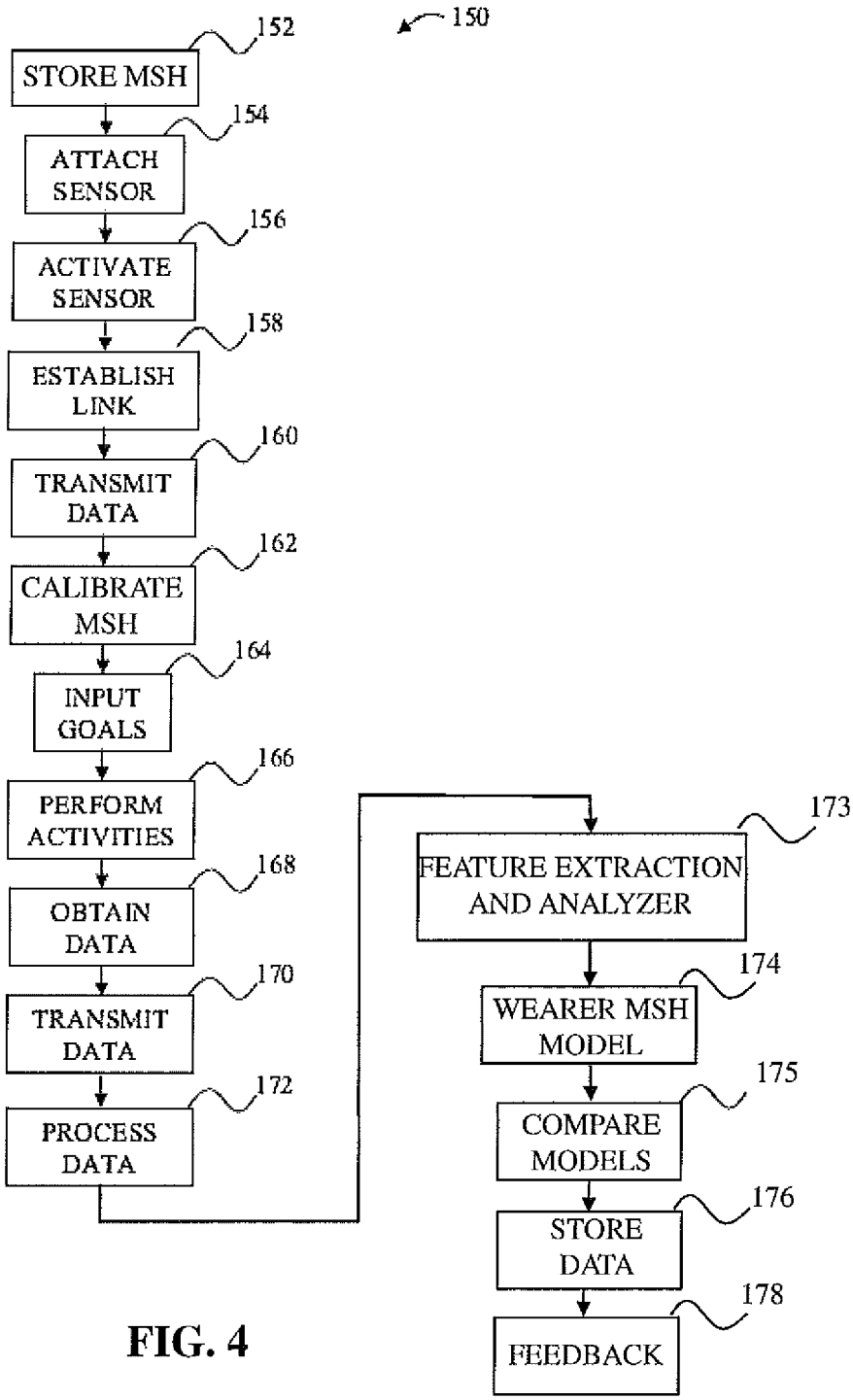
FIG. 4 depicts a process that may be controlled by the system processor of FIG. 1 for obtaining exercise monitoring data from the wearable transducers of FIG. 1.

Referring to FIG. 4, there is depicted a flowchart, generally designated 150, setting forth an exemplary manner of operation of the network 100. Initially, the MSH 110 may be stored within the memory 108 (block 152). Next, one or a plurality of wearable transducers $102_x$ are placed on a wearer such as an individual (block 154).

In one embodiment, the wearable transducers $102_x$ are placed on specific body parts of the wearer based on prior knowledge which is known to the MSH 110. In this embodiment the wearable transducers $102_x$ are small and can be worn by wearer without affecting the wearer's ability to perform an exercise routine. The wearable transducers $102_x$ can be non-invasive or minimally invasive. In one embodiment, the wearable transducers $102_x$ are hypo-allergenic. In an alternative embodiment, the wearable transducers $102_x$ are contained in a body suit worn by the wearer.

Based on a selection provided by the wearer, a trainer, or other individuals using one of the I/O devices $104_x$, an exercise object associated with an exercise routine is downloaded from the exercise routine database 116 to the MSH 110. As discussed above, sub-blocks of the memory 108, e.g., the MSH 110 and the exercise routine databases 116 can be remotely situated from one another. Therefore, for example, the MSH 110 and the exercise routine database 116 need not be physically connected. The stored exercise object may include models of correct and incorrect performance of an exercise routine which are created before being loaded in the memory 108. The downloaded exercise object includes model physiologic data, such as limb velocity, heart rate, respiration rate, temperature, blood oxygen content, etc., and other model features, such as range of motion, three dimensional velocity vectors, acceleration, muscle strength, exerted force, etc., that are hereinafter collectively referred to as an optimal performance data. The optimal performance data, thus, refers to data that would be observed if the wearer optimally performs the exercise routine including correct movements, correct form, correct range of motion, correct speed, etc.

In one embodiment, a new exercise routine can be generated by combining parts of existing exercise routines in the exercise routine database 116. The new exercise routine can then be saved in the exercise routine database 116 for a future selection. The selected exercise routine becomes the baseline of movements that the processing unit 106 uses to compare the movements of the wearer as sensed by the sensor suites $\mathbf{104}_x$ of the transducers $\mathbf{102}_x$.

In one embodiment, once one or more wearable transducers $\mathbf{102}_x$ are placed on the wearer and the downloading of the exercise routine is completed, the wearable transducers $\mathbf{102}_x$ are activated by the processing circuit 106 through the communications network 124 (block 156). In one embodiment, placement of the wearable transducers $\mathbf{102}_x$ along with movement of the wearer is sufficient to activate the wearable transducers $\mathbf{102}_x$. The processor 132 then initiates data capture subroutines which are in the non-volatile memory $\mathbf{134}_x$. Additionally, the wearable transducers $\mathbf{102}_x$ establish the communications link 124 with the processing circuit 106 (block 158).

Once the downloading of the exercise routine is completed, the wearer is directed, by way of one or more of the I/O devices $\mathbf{104}_x$, to calibrate the MSH 110 (block 162). The calibration of the MSH 110 is accomplished by passing initial output from the sensor suites $\mathbf{140}_{1\text{-}x}$ through the signal processing circuit $\mathbf{138}_x$ to the processor $\mathbf{132}_x$. The initial data from the wearable transducers $\mathbf{102}_x$ are then transmitted to the processing circuit 106 over the link 124 (block 160). Calibration of the MSH 110 provides the MSH 110 with an initial state for the wearer wearing the wearable transducers $\mathbf{102}_x$. For example, the output of the sensor suite $\mathbf{140}_{1\text{-}1}$ is used to establish y-axis and z-axis values for the wearer of the wearable transducer $\mathbf{102}_x$ in a known position such as standing or pro state.

The goals database 120 (block 164) is then populated. The data used to populate the goals database 120 may be input from one or more of the I/O devices $\mathbf{104}_x$. Alternatively, the wearable transducer $\mathbf{102}_x$ may be configured with a user interface, allowing the wearer of the wearable transducer $\mathbf{102}_x$ to input goals data.

The wearer then proceeds to perform the selected exercise routine (block 166). As the exercise routine is performed, physiologic data is obtained from the sensor suites $\mathbf{140}_{1\text{-}x}$ (block 168). The sensor data are captured by the subroutines on the sensors and passed through the signal processing circuit $\mathbf{138}_x$ to the processor $\mathbf{132}_x$. The sensor data is then transmitted to the processing circuit 106 over the communications network 124 (block 170). The sensor data is processed by the processing circuit 106 (block 172), and analyzed by a feature extraction and analyzer subroutines stored in the MSH 110 (block 173).

The feature extraction and analyzer subroutines associate the pattern of the received physiologic data with predetermined patterns to identify a type of movement. The identified type of movement is then processed using the MSH 110 to model the movement which resulted in the sensed physiologic data.

The processing circuit 106 uses the MSH 110 to process the sensor data to generate a virtual representation of the wearer's movements characteristics, i.e., the wearer's MSH model (block 174) such as range of motion, force exerted by the wearer, etc. The processing circuit 106 integrates data from multiple wearable transducers $\mathbf{102}_x$ by aggregating a particular feature in a fixed time window. These features are analyzed using a pre-trained support vector machine (discussed in reference to FIG. 5, below). The outputs of the pre-trained support vector machine are used by the pre-trained hidden Markov model, which integrates information over time and constructs a virtual model of the wearer's exercise movement as the exercise is being performed. In one embodiment, the processing circuit 106 analyzes an exercise routine according to multiple phases, e.g., warm-up phase, stretching phase, cardiovascular phase, strength-training phase, and cool-down phase. Each phase may be time-based.

The virtual model generated by the processing circuit 106 is then compared with the optimal performance data to determine deviations, as indicated by the block entitled compare models (block 175). Two different types of comparisons are performed to determine the deviations. First a quantitative comparison is made with the optimal performance data. Second a qualitative comparison is made with the optimal performance data. In the quantitative comparison, statistical, motion kinematics and motion dynamics, and physiological comparisons are performed. The statistical deviations include variables such as percent conformance by the wearer in each phase of the exercise routine. Motion kinematics deviations include performance variables such as conformance of the wearer to key segments of the exercise routine in each phase, including speed, range and track of movements, etc. Motion dynamics deviations include performance variables such as conformance of the wearer to key segments of the exercise routine in each phase, including force exerted by the wearer at different parts of the wearer's body, etc. Physiological deviations include physical parameters, such as heart rate, respiration rate, and blood oxygen of the wearer, etc. Therefore, the quantitative comparisons are mainly directed to identifying deviations of the performance of the exercise routine based on an analysis which involves comparing quantitative performance attributes of the wearer to the optimal performance data. A high-level conformance measure can also be tracked and reported that aggregates data indicating how close the quantitative results are to the optimal performance data. For example, a 90% aggregate indicates the wearer's MSH model deviated 10% from the quantitative parameters in the optimal performance data.

In addition to the quantitative comparison, a qualitative comparison is conducted. The qualitative analysis uses human motion kinematics and dynamics measurements to compare the quality of the wearer's movements to the optimal performance data. While, range of a motion can be calculated simply by subtracting a positional vector associated with the beginning of a movement from a positional vector associated with the ending of the movement, quality of the movement is determined by calculating intermediate positional vectors between the beginning and the ending of the movement. In addition to positional vectors, force vectors, velocity vectors, and acceleration vectors can also be compared at different points between the beginning of the movement and the end of the movement to the optimal performance data in the qualitative comparison analysis. A high-level conformance measure can also be tracked and reported that aggregates data indicating how close the qualitative results are to the optimal performance data. For example, a 90% aggregate indicates the wearer's MSH model deviated 10% from the quantitative parameters in the optimal performance data. The data associated with both quantitative and qualitative deviations between the wearer's movements and the optimal performance data are also recorded in the past movement database 118 (block 176).

In one embodiment, in identifying the deviations between the wearer's movements and the exercise routine downloaded in the MSH 110, the processing unit 106 may also take into account the data populated in the goals database 120. For example, if the wearer had provided an input of 110% for the goal database, the deviations are determined not just based on the exercise routine but based on an enhanced version of the exercise routine commensurate with the goal. In one embodiment, other outputs of the MSH 110 include a count of correct repetitions, time between repetitions, and a value characterizing the progress of training. The sensor data are then stored in databases 114 (block 176).

As the processing unit 106 identifies the above described movements and deviations, the processing unit 106 provides feedback signals to the transducers $\mathbf{102}_1$ over the link 124 (block 178). The feedback signals are received by the processor $\mathbf{132}_1$ which interprets and processes these feedback signals. The processor $\mathbf{132}_1$ generates digital signals in response to the feedback signals and provides these signals to the signal processing circuit $\mathbf{138}_1$. The signal processing circuit $\mathbf{138}_1$ generates analog equivalents of the digital signals and provide the analog signals to the actuator interface $\mathbf{128}_1$. The transducer $\mathbf{102}_1$ then provides feedback in the form of tactile vibration, audible, temperature, and alike to the wearer. The feedback may be used to indicate that the wearer is varying from the exercise routine, that the wearer is optimally performing the movements, or that the user performance is within an acceptable range of the optimal data.

In one embodiment, the feedback signals generated by the processing unit 106 are provided to the wearer by way of the I/O devices $\mathbf{104}_x$ over the link 126. In this embodiment, visual renderings, e.g., images displayed by liquid crystal displays or light emitting diodes, and audible feedback are presented to the wearer to guide the wearer as the exercise routine is performed including the provision of feedback regarding deviations from the optimal exercise routine. While the wearer is conforming to the exercise routine, the processing unit 106 can provide the I/O devices $\mathbf{104}_x$ with visual renderings indicating a variety of information, such as the wearer's heart rate, respiration rate, information about the next phase of the exercise routine, etc. Regardless of how the feedback is provided, the wearer can advantageously gain an independence from reliance on observers tasked with evaluating whether the wearer is correctly performing the exercise.

The foregoing actions may be performed in different orders. By way of example, goals may be stored prior to attaching a transducer $\mathbf{102}_x$ to the wearer. Additionally, the various actions may be performed by different components of the network 100. By way of example, in one embodiment, all or portions of the memory 108 may be provided in the wearable transducer $\mathbf{102}_x$. In such an embodiment, the output of the MSH 110 may be transmitted to a remote location such as a server remote from the sensor for storage.

The MSH 110 in one embodiment is configured to determine deviations between the movements of the wearer of the transducer $\mathbf{102}_x$ and the stored exercise routine. Accordingly, the MSH 110 is configured to perform the procedure 200 of FIG. 5. The processing circuit 106 receives a frame of data from the sensor suites $\mathbf{140}_{1\text{-}x}$ (block 202). In one embodiment, one frame of data is based on a ten second sample utilized to compute a series of motion features (blocks 204-220). The pre-trained multilayer perceptron/support vector machine/hidden Markov model first extracts sensor data from the sensor suites $\mathbf{140}_{1\text{-}x}$ to analyze changes in the orientation in the x-axis, y-axis, and the z-axis.

Figure 5:
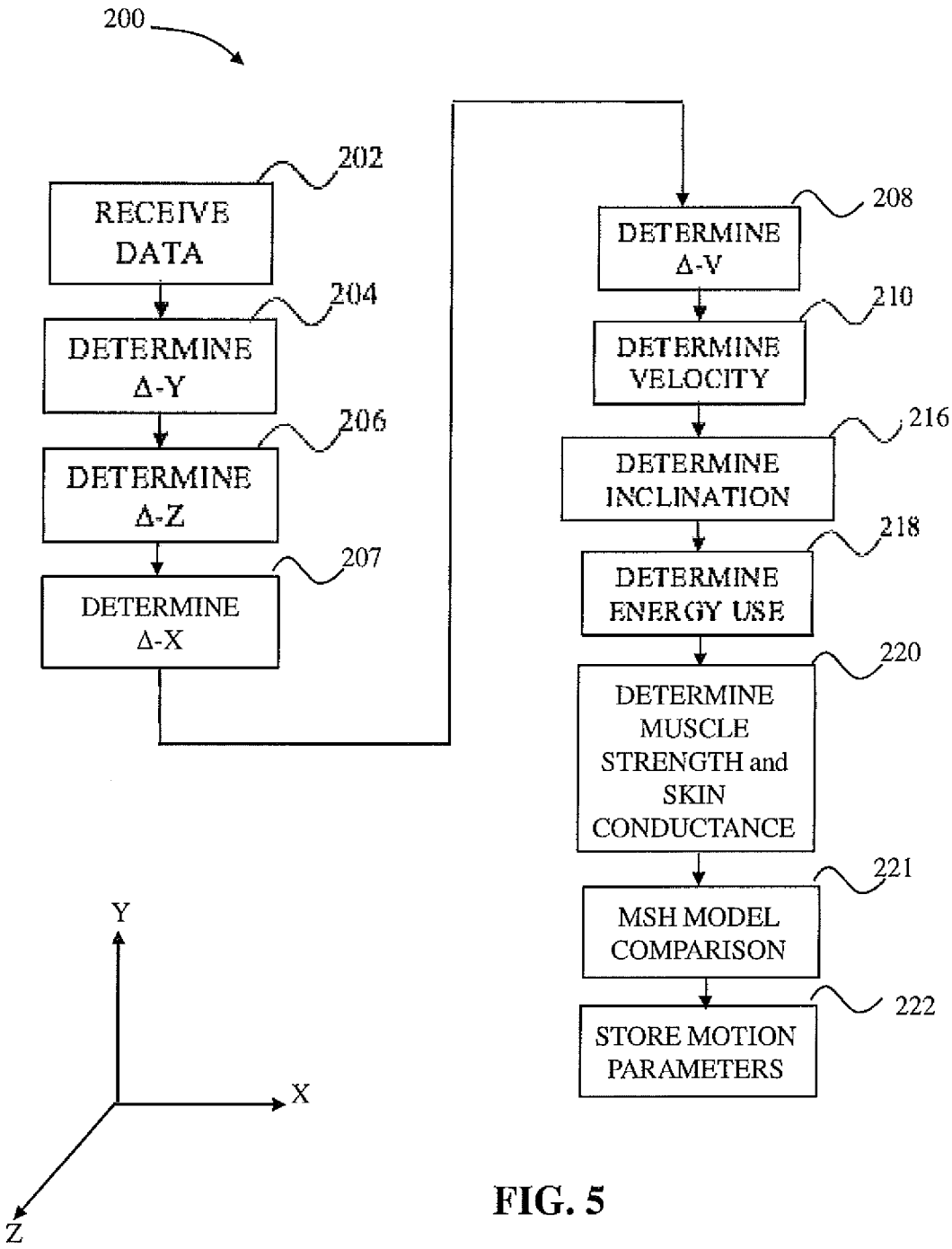
FIG. 5 depicts a process of analyzing data from a wearable transducer of FIG. 1 to generate an inference as to the movement of a subject wearing a wearable transducer using a multilayer perceptron/support vector machine/hidden Markov model.

Based upon the initial calibration data (block 162 of FIG. 4) and the most recently received frame data, the change in the orientation of the wearer in the y-axis is determined (block 204). Similarly, based upon the initial calibration data (block 162 of FIG. 4) and the most recently received frame data, the change in the orientation of the wearer in the z-axis is determined (block 206). Similarly, based upon the initial calibration data (block 162 of FIG. 4) and the most recently received frame data, the change in the orientation of the wearer in the x-axis is determined (block 207). A Cartesian coordinate system including an x-axis, a y-axis, and a z-axis is depicted in FIG. 5. The x-axis is parallel to a line defined by the span of the wearer's arms when the arms are spread from side to side. The z-axis is a vertical axis and defined by the direction of Earth's gravity. The y-axis is perpendicular to the x-axis and the z-axis.

The frame data from the sensor suites $\mathbf{140}_{1\text{-}x}$ is also used to obtain a three dimensional vector indicative of the acceleration of the wearer (block 208) and to determine the three dimensional velocity of the wearer (block 210).

The data from the sensor suites $\mathbf{140}_{1\text{-}x}$ is further used to determine the relative inclination of the wearer (block 216) and data indicative of the energy use of the wearer is also obtained from the frame data and the energy expenditure is determined (block 218). Energy usage may be determined, for example, from data obtained by a sensor suite $\mathbf{140}_{1\text{-}x}$ configured as a thermometer, calorimeter, accelerometer, or a combination of multiple sensor elements of the suite. By way of example, relative inclination, periodicity and spectral flatness of the acceleration data help distinguish between a series of steady-state movement, e.g., running or walking and a series of varying movement, e.g., a leg raise.

The data from the sensor suites $\mathbf{140}_{1\text{-}x}$ is cross referenced with the optimal performance data to determine muscle strength (block 220). Also, galvanic skin response sensors provide data directed to skin conductance which can be used to determine the amount of perspiration (block 220). The set of computed features is then used to determine the extent of the deviations from the optimal model in the exercise routine database 116, as indicated by the block entitled MSH model comparison (block 221). The motion parameters determined by the MSH 110 are then stored, with a date/time stamp, in the past movement database 118, as indicated by the block entitled store motion parameters (block 222) to be used for the next time the wearer accesses the network 100.

While the MSH 110 is accessed to compare the movements of the wearer to an exercise routine, location and date/time stamped data is also being provided to the past movement database 118. For example, in embodiments incorporating a GPS sensor in a sensor suite $\mathbf{140}_{1\text{-}x}$, GPS data may be obtained at a given periodicity, such as once every thirty seconds, transmitted to the processing circuit 106 and stored in the past movement database 118. Additionally, data identifying the other transmitters in the body-area network 142 or 146 is stored in the past movement database 118. Of course, transmitters within the body-area network 142 or 146 need not be associated with a wearable transducer $\mathbf{102}_x$. For example, a cellular telephone or PDA without any sensors may still emit a signal that can be detected by the wearable transducer $\mathbf{102}_x$.

The data within the memory 108 may be used in various applications either in real time, for example, by transmitting data over the communications link 124 to the transducer $\mathbf{102}_x$, or at another time selected by the wearer or other authorized individual by access through an I/O device $104_x$. The applications include movement monitoring, movement recording, movement goal setting, and movement reviewing.

Figure 6:
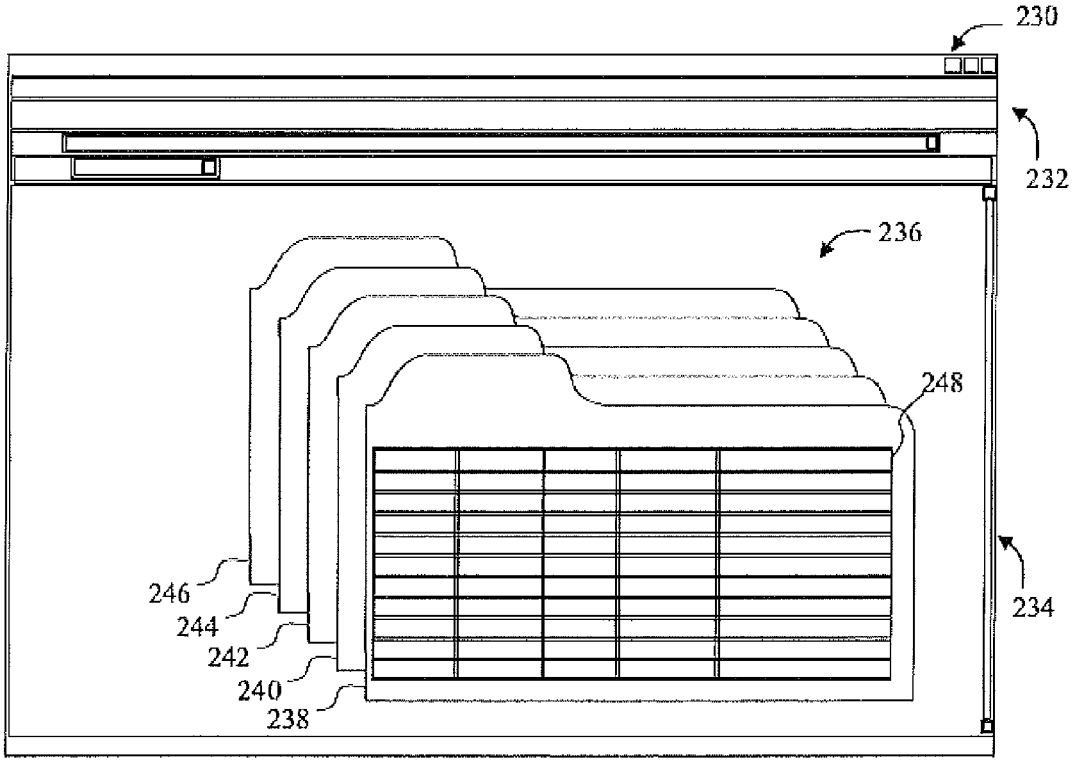
FIG. 6 depicts a screen populated with data, which data may be transmitted over a communications link such as the Internet and used to display obtained exercise monitoring data from the wearable transducers of FIG. 1.

A screen 230 which may be used to provide movement monitoring data from the memory 108, such as when the data is accessed by an I/O device $104_x$ coupled to the memory 108 by an internet connection, is depicted in FIG. 6. A person skilled in the art appreciates that for the purpose of reducing data traffic, only the data used for populating the screen 230 may be transmitted and not the entire content of the screen 230. The screen 230 includes a navigation portion 232 and a data portion 234. A number of folders 236 are rendered within the data portion 234. The folders 236 include a summary folder 238, a movement monitoring folder 240, a movement recording folder 242, an exercise goal setting folder 244, and an exercise reviewing folder 246. The summary folder 238 includes a chart 248. Data that may be rendered on the chart 248 include identification of the individual or wearer associated with the transducer $102_x$, summary fitness data, and other desired data.

Figures 7A, 7B, 7C:
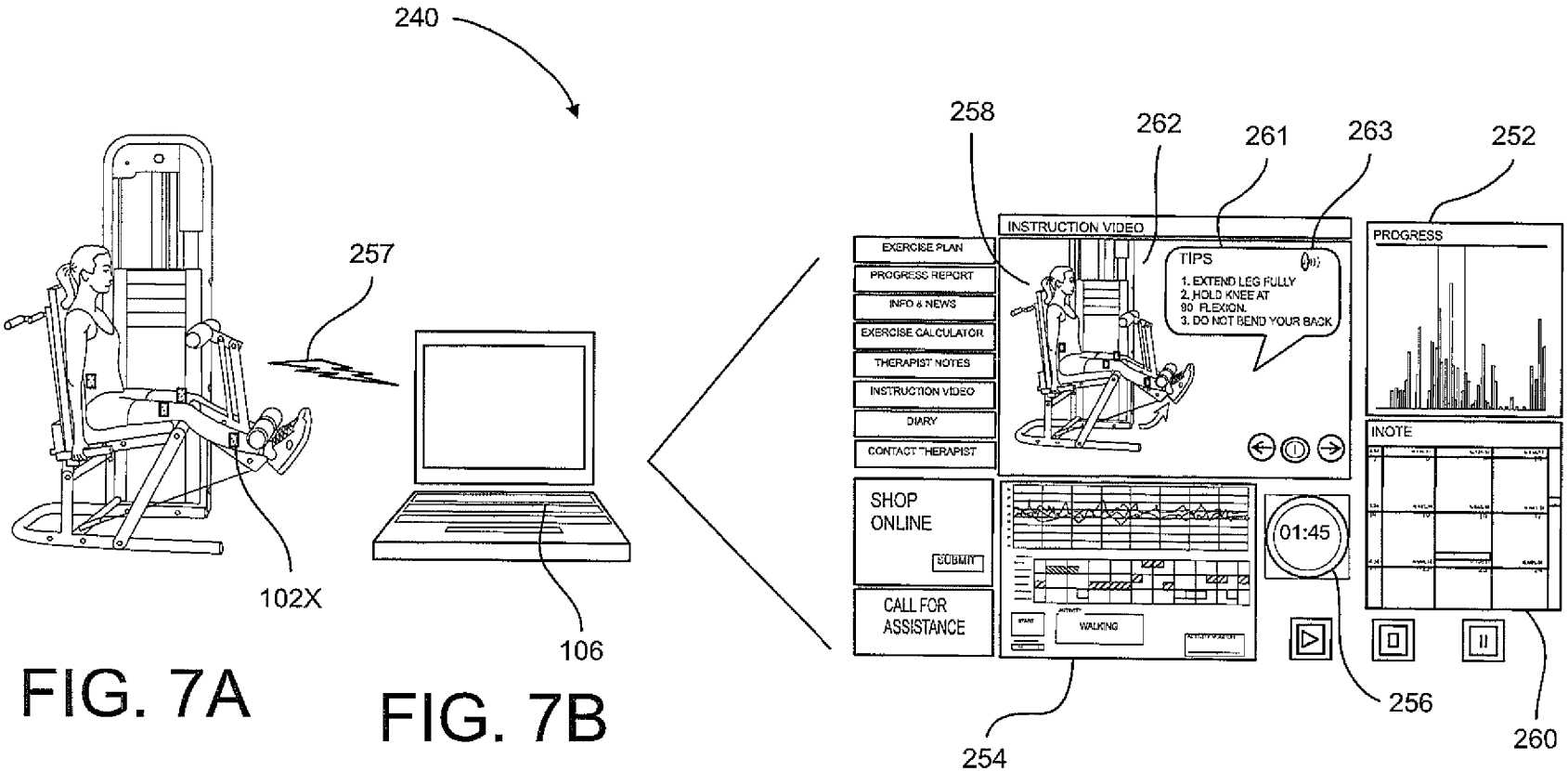
FIG. 7A depicts a schematic of an individual performing an exercise routine with wearable transducers transmitting data using a wireless link.
FIG. 7B depicts a schematic of a personal computer for receiving the wireless data transmitted from the wearable transducers.
FIG. 7C depicts the contents of an exemplary movement information folder rendered within the screen of FIG. 6.

By selecting the movement monitoring folder 240, the folder 240 is moved to the forefront of the screen 230. When in the forefront, a viewer observes the folder 240 as depicted in FIGS. 7A-7C. A wearer is depicted performing an exercise routine (FIG. 7A), wearing wearable transducers $102_X$ on various body parts. Data from the transducers $102_X$ is transmitted to a processing circuit 106 (part of a laptop) over a wireless communication link 257. The contents of an exemplary movement monitoring folder, rendered in the screen of FIG. 6, are depicted in FIG. 7C. In this embodiment, the movement monitoring folder 240 displays data fields 252, 254, and 256 which are used to display the progress of the exercise routine in a bar-graph (252), type of exercise and a time-based progress window (254), and the duration of the exercise performed by the wearer (256). The data fields presented for different exercises may be modified. The movement monitoring folder 240 further provides a calendar 260 which includes the date and time of the exercise routine.

Multiple exercise context segments 258, 261, and 263 are also provided in an exercise context window 262, which include diagrams showing the form of the wearer performing the exercise routine (258), textual feedback (261) as well as audible feedback (263).

Figure 8:
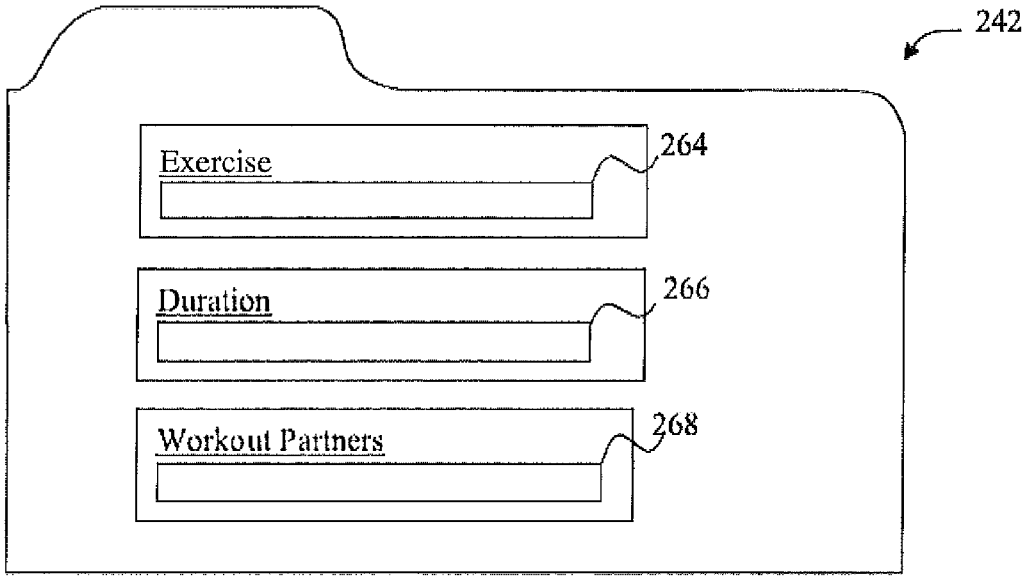
FIG. 8 depicts the contents of an exemplary movement recording folder rendered within the screen of FIG. 6.

By selecting the movement recording folder 242 from the screen 230 of FIG. 6, the folder 242 is moved to the forefront of the screen 230. When in the forefront, a viewer observes the folder 242 as depicted in FIG. 8. In this embodiment, the movement recording folder 242 displays editable data fields 264, 266, and 268. The editable data fields 264, 266, and 268 allow a user to add or modify information related to a recorded exercise. For example, unidentified workout partners may be identified to the network 100 by editing the field 268. This data may be used to modify the past movement database 118 so that the network 100 recognizes the workout partner in the future. For example, an individual's identity may be associated with a particular cell phone beacon that was detected with the wearable transducer $102_x$. The movement recording folder 242 may include additional editable fields.

Figure 9:
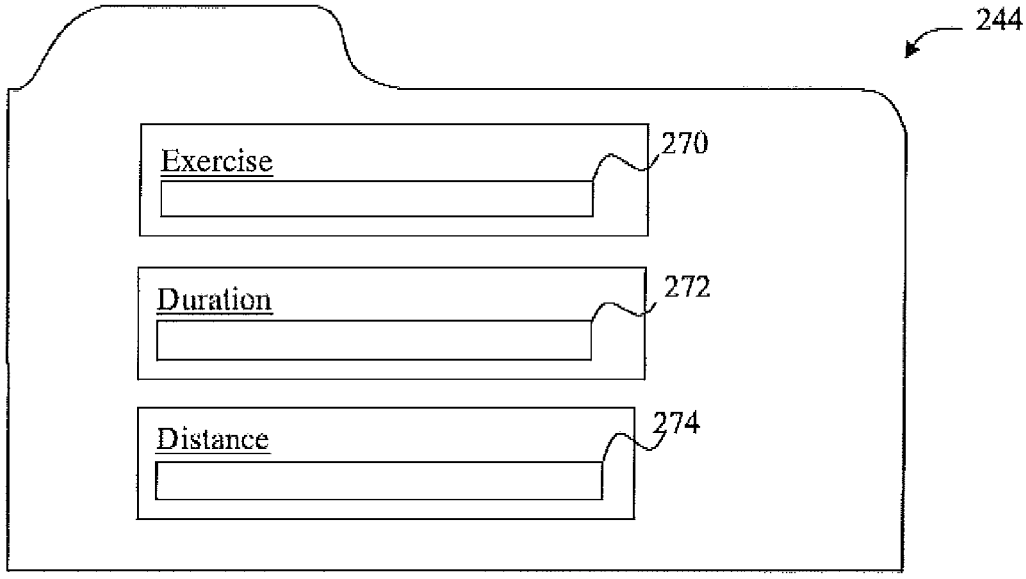
FIG. 9 depicts the contents of an exemplary exercise goals folder rendered within the screen of FIG. 6.

By selecting the exercise goal setting folder 244 from the screen 230 of FIG. 6, the folder 244 is moved to the forefront of the screen 230. When in the forefront, a viewer observes the folder 244 as depicted in FIG. 9. In this embodiment, the exercise goal setting folder 244 displays editable data fields 270, 272, and 274. The editable data fields 270, 272, and 274 allow a user to record goals for future exercises. For example, a goal of running at a particular average speed may be identified in the field 270 and a duration of 90 minutes may be stored in the field 272. Additionally, a strength goal of, for example, 40 pounds may be edited into field 274. The exercise goal setting folder 244 may include additional editable fields such as average speed, etc.

Figure 10:
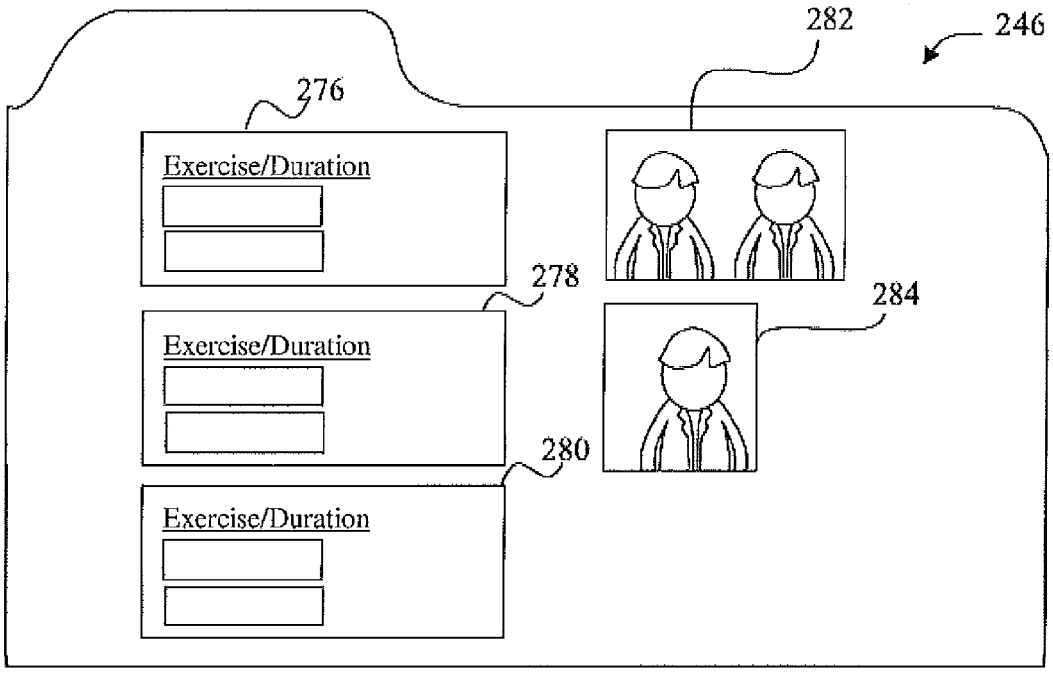
FIG. 10 depicts the contents of an exemplary exercise review folder rendered within the screen of FIG. 6.

By selecting the exercise reviewing folder 246 from the screen 230 of FIG. 6, the folder 246 is moved to the forefront of the screen 230. When in the forefront, a viewer observes the folder 246 as depicted in FIG. 10. In this embodiment, the exercise reviewing folder 246 displays exercise data fields 276, 278, and 280. The exercise data fields 276, 278, and 280 allow a user to review exercises which were conducted over a user defined time frame. Additional information may also be displayed. For example, data fields 282 and 284 identify other individuals that were present during the exercise associated with the data in the data fields 276 and 278, respectively.

Coaches and other individuals can review the screens described above to ascertain historical data related to the performance of the wearer and to further identify where the wearer has failed to effectively perform the exercise routine. Real-time short term metrics, such as a count of correct repetition, velocity and acceleration of each repetition, as well as long term metrics, such as increase in strength, flexion, extension, rotation, are tracked and reported in the above described screen. Also, information about timing between repetitions of an exercise routine, such as duration of breaks taken between the repetitions, are tracked and reported in the above described screens. New and effective exercise programs can then be generated as described above with reference to FIG. 4.

Figure 11:
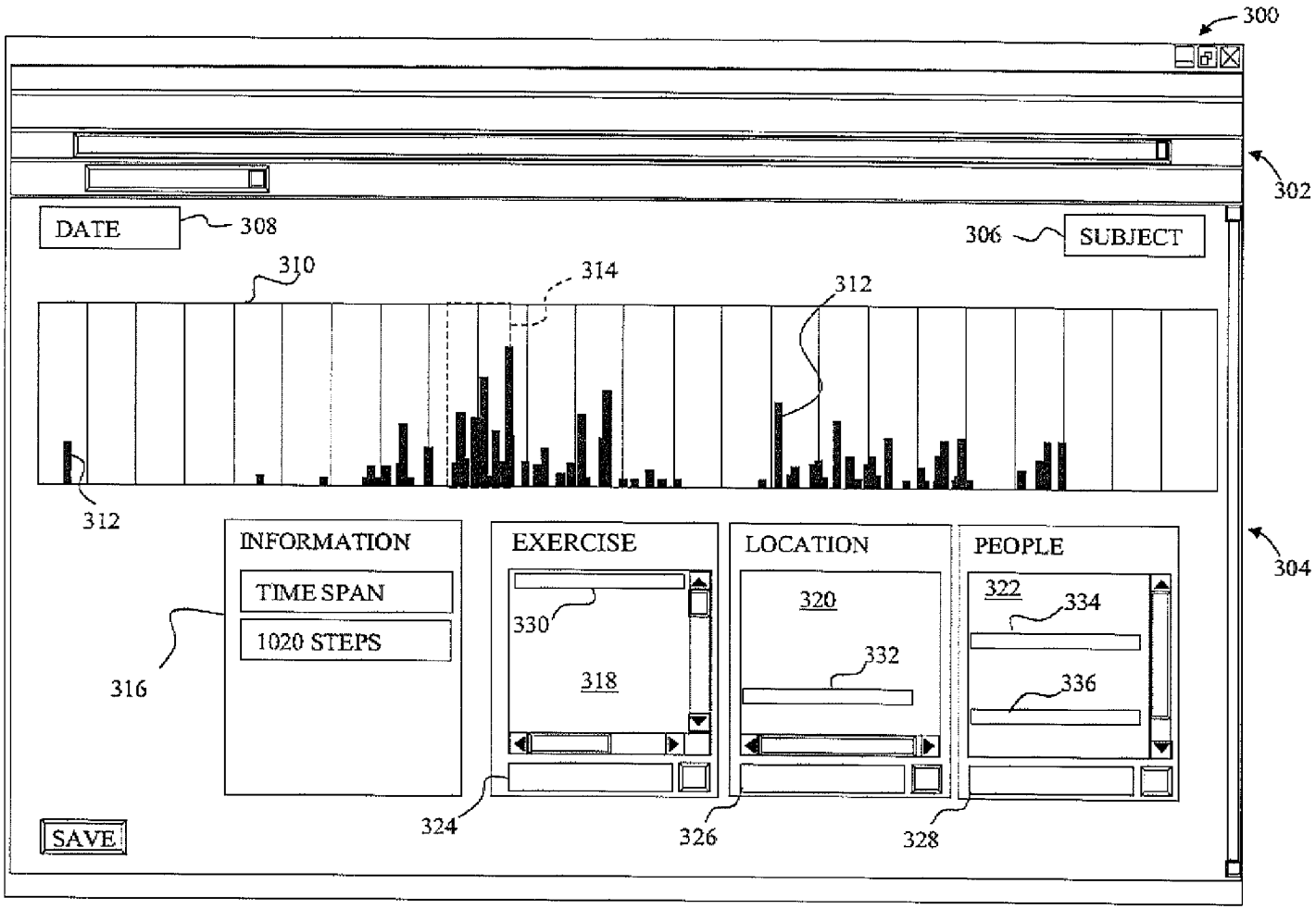
FIG. 11 depicts an alternative screen that may be accessed by a user to review movement of a subject over a predefined period including a graphic display of energy used, a summary of movements within a focus window, identification of movements within the focus window, the location at which the movements in the focus window were performed, and others accompanying the subject during performance of the exercise.

A variety of different screens may be used to display data obtained from the memory 108. Additionally, the data selected for a particular screen, along with the manner in which the data is displayed, may be customized for different applications. For example, the screen 300 depicted in FIG. 11 may be used to provide an easily navigable interface for reviewing exercises over an extended period of time.

The screen 300 includes a navigation portion 302 and a data portion 304. The data portion 304 includes an identification field 306 for identifying the subject and a data field 308 which displays the date associated with the data in the data portion 304.

A daily exercise chart 310 within the data portion 304 shows the amount of calories expended by the subject. To this end, bar graphs 312 indicate caloric expenditure or range of motion over a period of a month depicted in the chart 310. The data for the bar graphs 312 may be obtained, for example, from the past activities database 118.

A focus window 314 is controlled by a user to enclose a user variable window of exercise. In response, the underlying application accesses the databases 114 and displays data associated with the focus window 314 in an information field 316, an exercise field 318, a location field 320, and a people field 322.

The information field 316 displays general data about the focus window 314. Such data may include the time span selected by the user, the amount of calories expended during the selected time span, the number of steps taken by the subject during the selected time span, maximum speed of the subject during the selected time span, average speed of the subject during the selected time span, etc.

The exercise field 318 displays each identifiable exercise within the focus window 314. The exercise may be specifically identified or generally identified. For example, the network 100 may initially only be configured to distinguish activities based upon, for example, changes in velocity, changes in respiration, changes in heart rate, etc. Thus, the exercise identification may be "exercise 1."

The exercise field 318 includes, however, an editable field 324. The field 324 may be used to edit the identified exercise with additional descriptive language. Thus, the general identification may be further specified as "morning football drill," etc.

The location field 320 displays data in the form of each identifiable location at which the exercises within the focus window 314 were conducted. The location may be specifically identified or generally identified. For example, the network 100 may initially only be configured to distinguish location based upon a determined change in location. The location field 320 includes, however, an editable field 326. The field 326 may be used to edit the identified location with additional descriptive language. Thus, the general identification of a "location 1" may be further specified as "gym", "office" or "jogging route 1".

The people field 322 displays movement data in the form of each identifiable individual or subject present during the activities within the focus window 314. The people may be specifically identified or generally identified. For example, the MSH 110 may initially only be configured to distinguish different individuals based upon a different cell phone beacons. The people field 322 includes, however, an editable field 328. The field 328 may be used to edit the identified individual with additional descriptive language. Thus, the general identification of an "individual 1" may be further specified as "Joe", "Anastasia" or "co-worker".

Various functionalities may be incorporated into the screen 300 in addition to the functions set forth above so as to provide increased insight into the exercise habits of a subject. By way of example, in response to selecting an exercise within the exercise field 318, the data for the selected exercise may be highlighted. Thus, by highlighting the area 330 in the exercise field 318, a location 332 and individuals 334 and 336 are highlighted.

The network 100 thus provides insight as to a subject's exercises, such as the type of exercise.

The presentation of data from the databases 114 in the manner described above with reference to FIGS. 6-11 provides improved accuracy in capturing action specific metrics such as range of motion for one-leg-raise movement as opposed to a two-leg-raise movement. By selectively displaying data stored within the databases 114, subject matter experts (SME) can use the captured historical data to identify factors implicated by past failures for the subject. This allows the SME to design innovative and effective ways of structuring future activities so as to increase the potential for achieving goals.

Additionally, while the data may be used retrospectively, the data may also be presented to a subject in real-time. Accordingly, an athlete may easily change his workout routine from walking to running and fast walking so as to maintain a desired rate of energy expenditure.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. An exercise monitoring system comprising:

a communications network;

a wearable transducer configured to generate physiologic data associated with movement of a wearer, and to form a communication link with the communications network;

a system memory in which command instructions are stored;

a user interface operably connected to the computer; and a system processor configured to execute the command instructions to receive the generated physiologic data, identify a type of movement indicated by the generated physiological data, analyze the received physiologic data with a multilayer perceptron, support vector machine, or hidden Markov (MSH) model based on the idenfied type of movement, model the analyzed physiologic data, and generate feedback based on a comparison of the model and a stored exercise object.

2. The system of claim 1, wherein the wearable transducer is activated in response to the wearable transducer sensing movement of the wearer.

3. The system of claim 1, the wearable transducer includes:

an actuator interface configured to provide the generated feedback to the wearer;

at least one sensor configured to sense physiologic data associated with movement of the wearer;

a signal processing circuit configured to pre-process data from the at least one sensor and to post-process data for the actuator;

a transducer processor configured to process the pre-processed sensor data and to provide processed feedback data to the signal processing circuit; and a network interface configured to provide communication with the communications network.

4. The system of claim 3, wherein the transducer processor is further configured to transmit the processed sensor data via the network interface to the system processor and to receive the feedback data from the system processor via the network interface.

5. The system of claim 4, wherein the actuator interface provides the generated feedback data by at least one of a tactile-vibrational scheme, an audible scheme, and a thermal feedback scheme.

6. The system of claim 3, the wearable transducer further includes:

a transducer memory in which configuration information of the at least one sensor is stored; and a radio frequency communication circuit configured to link the wearable transducer to a plurality of other wearable transducers over an industrial, scientific, and medical frequency band.

7. The system of claim 6, wherein the radio frequency communication circuit is configured to use a BLUETOOTH protocol.

8. The system of claim 1, wherein the MSH model is configured to:

determine a change in a x-axis orientation of the wearable transducer;

determine a change in a y-axis orientation of the wearable transducer;

determine a change in a z-axis orientation of the wearable transducer; and determine a change in a three dimensional velocity of the wearable transducer.

9. The system of claim 8, wherein the MSH model is further configured to:

determine parameters of human motion kinematics based on the physiologic data generated by the wearable transducer; and determine parameters of human motion dynamics based on the physiologic data generated by the wearable transducer.

10. The system of claim 9, wherein the generated feedback data is based on a difference between the modeled analyzed physiologic data and an optimal performance data associated with an exercise routine.

11. The system of claim 10, wherein the difference includes a quantitative comparison and a qualitative comparison.

12. A method of monitoring physiologic data associated with an exercise routine performed by a user, comprising:

generating physiologic data using at least one wearable transducer worn by the user;

receiving the generated physiologic data at a system processor;

identifying a type of movement indicated by the received physiological data using the system processor;

analyzing the received physiologic data using the system processor based on the identified type of movement;

modeling the analyzed physiologic data using the system processor; and generating feedback based on a comparison of the model and a stored exercise object using the system processor.

13. The method of claim 12, wherein analyzing the received physiologic data comprises:

analyzing the received physiologic data with a multilayer perceptron, support vector machine, or hidden Markov (MSH) model.

14. The method of claim 13, wherein analyzing the received physiologic data with the MSH model comprises:

determining a change in a x-axis orientation of the plurality of parts of a user;

determining a change in a y-axis orientation of the plurality of parts of the user;

determining a change in a z-axis orientation of the plurality of parts of the user;

determining a change in a three dimensional velocity of the plurality of parts of the user;

determining a range of motion based on the physiologic data;

determining the strength of a muscle based on the physiologic data; and recommending a corrective action.

15. The method of claim 12, wherein generating feedback based upon the model comprises:

generating feedback based on a difference between the modeled analyzed physiologic data and an optimal performance data associated with an exercise routine.

16. The model of claim 15, wherein the difference includes a quantitative comparison and a qualitative comparison.

17. A method of monitoring physiologic data associated with an exercise routine performed by a user, comprising:

selecting an exercise routine using an input/output device;

receiving an exercise object for a model exercise routine associated with the selected exercise routine at a system processor;

transmitting physiologic data associated with sensed physiologic conditions of a user to the system processor using a wearable transducer worn by the user;

identifying a type of movement indicated by the received physiological data using the system processor;

analyzing the transmitted physiologic data using the system processor based on the identified type of movement;

generating a model based on the analyzed transmitted physiologic data using the system processor;

comparing the exercise object with the model using the system processor; and generating selective feedback based on the comparison using the system processor.

18. The method of claim 17, wherein analyzing the transmitted physiologic data comprises:

analyzing the transmitted physiologic data with a multilayer perceptron, support vector machine, or hidden Markov (MSH) model.

19. The method of claim 18, wherein analyzing the transmitted physiologic data with the MSH model comprises:

determining a change in a x-axis orientation of the plurality of parts of the user;

determining a change in a y-axis orientation of the plurality of parts of the user;

determining a change in a z-axis orientation of the plurality of parts of the user;

determining a change in a three dimensional velocity of the plurality of parts of the user;

determining a range of motion based on the physiologic data; and determining the strength of a muscle based on the physiologic data.

20. The method of claim 17, wherein generating selective feedback based on the comparison comprises:

generating selective feedback based on a difference between the modeled analyzed physiologic data and an optimal performance data associated with an exercise routine, wherein the difference includes a quantitative comparison and a qualitative comparison.

* * * * *